United States Patent [19]

Stecklein

[11] Patent Number: 4,477,987

[45] Date of Patent: Oct. 23, 1984

[54] SPILL SHEET STRUCTURE ON LOADER BUCKET

[75] Inventor: Gary L. Stecklein, San Antonio, Tex.

[73] Assignee: Deere & Company, Moline, Ill.

[21] Appl. No.: 441,358

[22] Filed: Nov. 15, 1982

[51] Int. Cl.[3] ..... E02F 3/28

[52] U.S. Cl. ..... 37/118 R; 414/722

[58] Field of Search ..... 37/118 R, 118 A, 141 R, 37/DIG. 4, DIG. 5, DIG. 9; 414/722

[56] References Cited

U.S. PATENT DOCUMENTS

| | | | |
|---|---|---|---|
| Re. 29,603 | 4/1978 | Oke et al. | 414/722 |
| T981,001 | 4/1979 | McReynolds | 37/118 R |
| 3,523,621 | 8/1970 | Anderson et al. | 37/118 R X |
| 3,773,196 | 11/1973 | Shepherd | 37/118 R |
| 3,807,587 | 4/1974 | Maurer | 37/118 R |
| 3,845,870 | 11/1974 | Balderson et al. | 37/118 A |
| 4,395,193 | 7/1983 | Christensen et al. | 414/722 |

*Primary Examiner*—Edgar S. Burr
*Assistant Examiner*—Moshe I. Cohen

[57] ABSTRACT

A spill sheet structure mounted to extend upwardly and forwardly from the rear wall of a loader bucket which is composed of a main single plate member with a central section that extends substantially the transverse width of the bucket and which is formed in a U-shaped configuration having front and rear spaced-apart walls with the front wall being in general continuation of the rear wall of the bucket and the rear wall of the central section extending behind the rear wall of the bucket and being formed so that its lower edge engages and is welded to the rear surface of the rear bucket wall. End sections of the main plate forming the spill sheet are at a level lower than the central section of the bucket so as to give visibility to an operator of the loader to determine whether the bucket is fully loaded.

6 Claims, 4 Drawing Figures

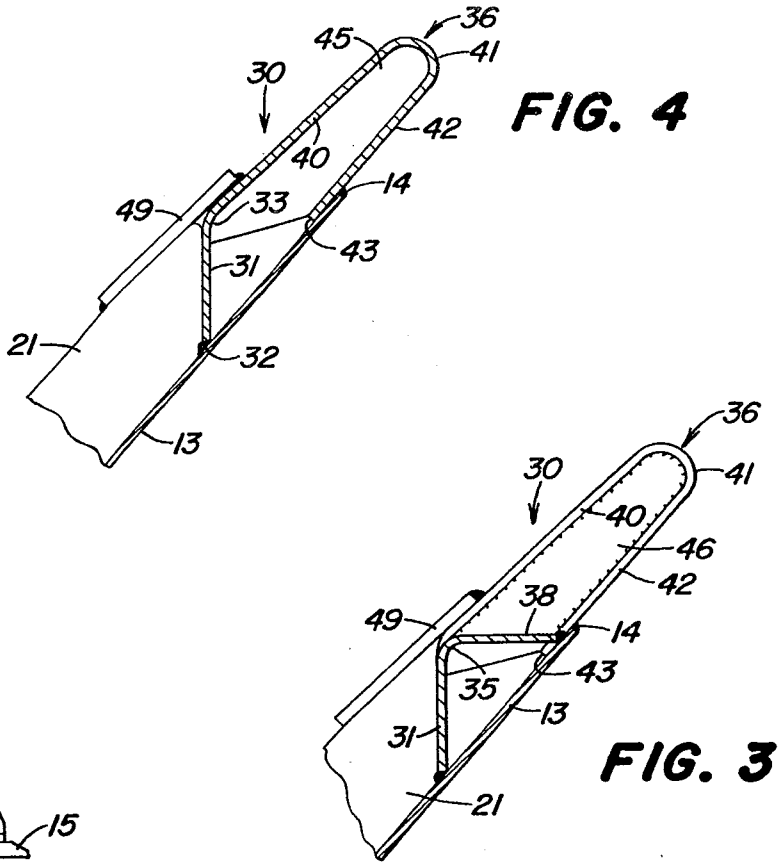
FIG. 4
FIG. 3
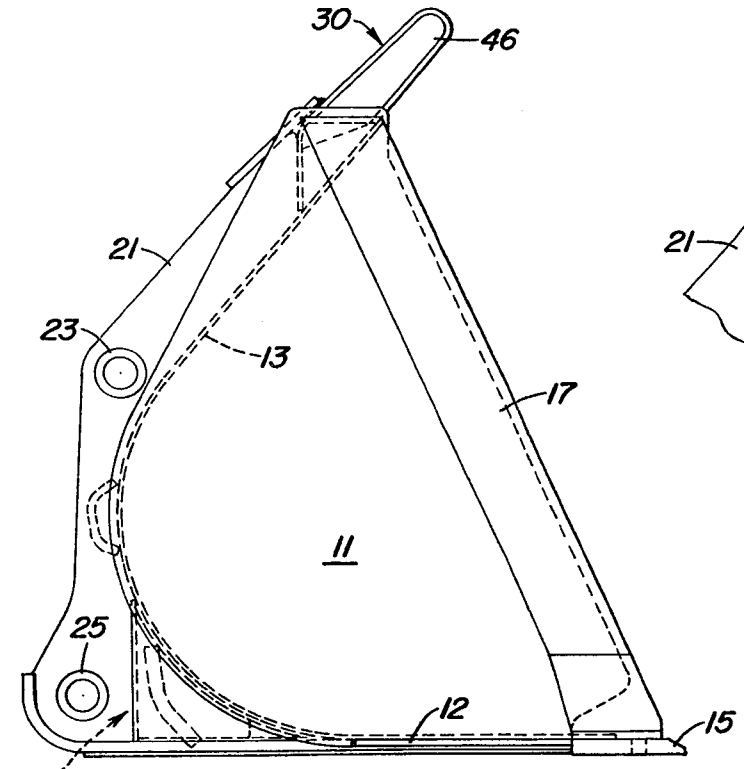
FIG. 1

SPILL SHEET STRUCTURE ON LOADER BUCKET

BACKGROUND OF THE INVENTION

Power loaders normally have buckets provided with a spill sheet that extends upwardly and forwardly from the upper edge of the rear wall of the bucket. To a degree, the spill sheet serves as a continuation of the rear wall. In most instances, the ends of the spill sheets are reduced in height size so that as the bucket becomes fully loaded with material, or upon a fully loaded bucket being rolled back, the ends will permit material in the bucket to pass out of the bucket over the reduced ends. Thus, an operator may view the bucket to determine whether it is fully loaded. Also, it is heretofore been known to provide bracing or framing along the top edge of the bucket to ensure the transverse rigidity or integrity of that edge.

SUMMARY OF THE INVENTION

It is the purpose of the present invention to utilize a spill sheet structure, not only for the purpose of the conventional spill sheet, but also to construct it in a manner in which it operates as a box-like channel with the upper edge portion of the bucket so as to give additional strength to the bucket at its upper edge.

It is proposed in the present invention to provide a spill sheet structure composed generally of a single plate member formed, in part, of a U-shaped portion with front and rear legs or wall portions extending from the bight of the U-shaped portion and with the front leg extending upwardly and forwardly, generally as a continuation of the rear wall of the bucket. The rear leg is spaced rearwardly from the front leg and extends downwardly and rearwardly from the bight portion to join with a lower vertical section or portion that has its lower edge welded to the rear face of the rear wall of the bucket. The front leg portion of the plate member is welded to the bucket's rear wall adjacent its upper transverse edge. With such a construction, the plate member serving as the spill sheet combines with the upper portion of the bucket's rear wall to form a channel member giving transverse rigidity to the upper portion of the rear wall.

It is a further object of the invention to provide reduced or lower end sections in the plate structure so that an operator may view and determine the contents within the bucket. This is created by forming, in the aforesaid plate structure, a pair of horizontal plate portions that project rearwardly from the upper edge of the bucket's rear wall to join with vertical portions of the plate structures that extend to the rear surface of the bucket's rear wall. The vertical portions of the end sections are outward continuations of the vertical portion of the central section. Since the U-shaped central portion leaves openings at the end of the central portion of the spill sheet, additional plates are welded at the ends of the central portion so as to close those openings.

DESCRIPTION OF THE DRAWINGS

FIG. 1 is a side or end view of a loader bucket using the structure of the present invention.

FIG. 3 is a sectional view taken substantially along the line 3—3 of FIG. 2.

FIG. 4 is a sectional view taken substantially along the line 4—4 of FIG. 2.

DESCRIPTION OF THE PREFERRED EMBODIMENT

Figure 2:
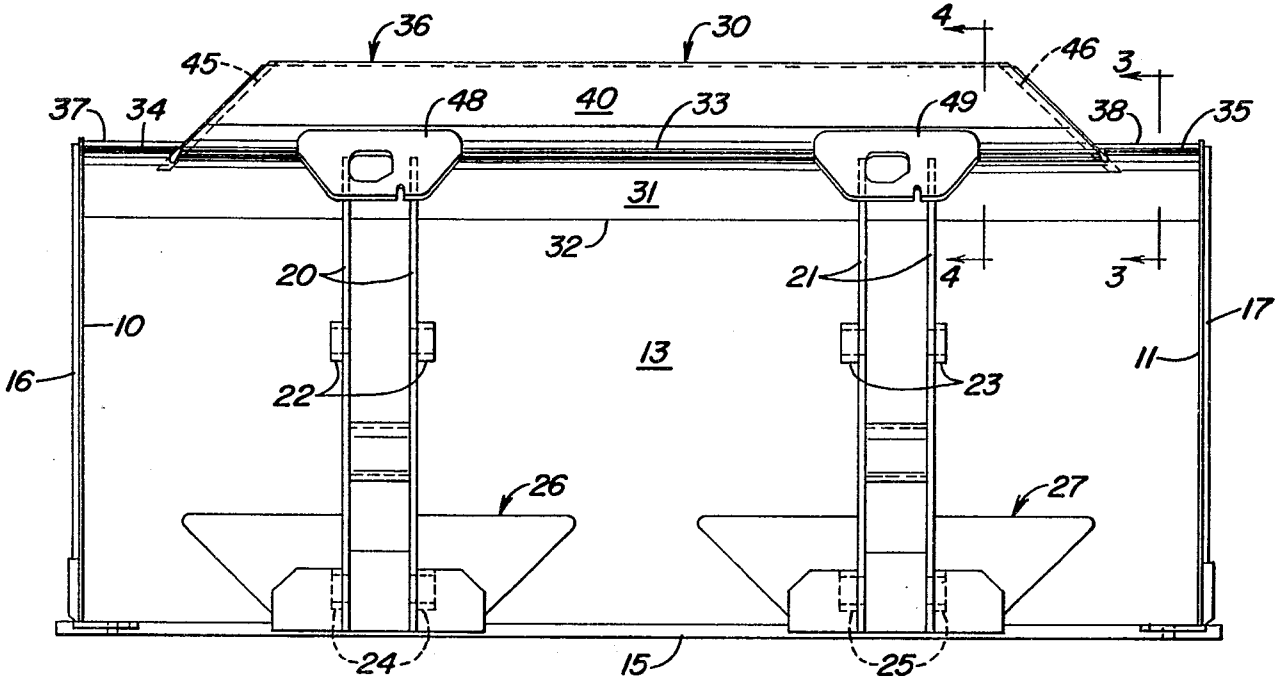
FIG. 2 is a rear view of the bucket shown in FIG. 1.

The bucket proper is composed of a pair of end plates or walls 10, 11. Extending between the end plates 10, 11 is the main wall structure of the bucket, composed of a bottom wall portion 12 and a transverse rear wall portion 13. The rear wall 13 extends upwardly and forwardly and terminates at an upper horizontal edge 14. For purposes of the present disclosure, reference to the bucket will be made when the bottom of the bucket is substantially horizontal or parallel to the ground and the bucket opens or faces forwardly. Fixed to and serving as a part of the bottom is a front cutting edge 15 that extends the full width of the bucket. A pair of vertical cutting plates 16, 17 extend forwardly of the respective end walls 10, 11 and have beveled front edges for penetrating into earth or material to be loaded into the bucket. The manner of attaching the cutting edges 15–17 is well known and is not part of the present invention.

Two pairs of mounting plates 20, 21 are fixed to and extend rearwardly from the bucket wall structure. The mounting plates 20, 21 carry upper, outwardly projecting bosses 22, 23, respectively. Lower bosses 24, 25 project outwardly from the respective plates 20, 21. The bosses 22–25 are aligned with openings in the respective plates 20, 21 and with those openings, serve as bushings for receiving pivot pins that connect them to the loader arms and the bucket tilting mechanism, both of which are not shown. Trusses or structural plate-like elements, indicated by the reference numerals 26, 27, respectively, extend from the rear surface of the rear wall 13 and serve generally to rigidify the vertical plates 20, 21 at the lower portion of the bucket.

The spill sheet structure is composed, for the most part, of a single plate structure or member 30 having a rear lower vertical section 31 extending across the full transverse width of the bucket. The lower edge 32 of the plate section 31 engages and is welded to the rear surface of the bucket rear wall 13. As is clearly evident in FIGS. 3 and 4, the edge 32 is considerably rearwardly and downwardly of the edge 14. The lower section 31 extends upwardly from the lower edge 32 to junctures 33, 34, 35 with a central U-shaped forward section 36 and two end sections 37, 38, respectively, extending outwardly from opposite ends of the central sections. Referring to FIGS. 1, 3 and 4, it becomes apparent that the junctures 33–35 are substantially at the level of the front upper edge 14 of the bucket's rear wall 13. The central section 36 extends transversely a major portion of the bucket width and has a rear wall portion 40 extending upwardly and forwardly from the juncture 33 to a horizontal rounded upper tip or bight portion 41. From there, the central section 36 has a downwardly and rearwardly inclined front wall portion 42 that terminates at a lower horizontal edge 43 rearwardly of but substantially at the upper edge 14 of the rear wall 13. As may be seen from viewing FIG. 4, the upper edge 14 is welded to the front face of the wall portion 42. Also, the wall portion 42 is generally in the plane of the wall 13 and extends, in general, as an upward and forward continuation of that wall.

The end sections 37, 38 are composed of horizontal plate portions that extend forwardly from the respective junctures 34, 35 with the vertical section 31. The plate sections 37, 38 have their forward edges terminating at the rear surface of the wall 13 adjacent its upper edge 14. As may best be seen from viewing FIG. 3, the forward edges of the end sections 37, 38 are welded to that rear surface. The transverse outer edges of the end sections 37, 38, as well as the rear upright wall section 31, extend to and are welded to the end walls 10, 11, respectively.

Reviewing FIG. 2, the central section 36 has the ends thereof inclined upwardly and inwardly. Unless otherwise closed, the central section 36 would be open at its ends. For this purpose, there is provided a pair of plates 45, 46 generally shaped to the shape of the opening at the ends of the central section 36 and filling the gap at those ends to the surface of the respective sections 37, 38. The edges of the plates 45, 46, where needed, are beveled to conform to the shape of the inner surface of the center section 36. As may be seen best in FIG. 3, the plates 45, 46 extend into the area beneath and terminate at a lower level than the respective end portions 37, 38 and are welded to the vertical surfaces of the vertical plate section 31. The outer edges of the respective plates 45, 46 are welded to the inner surface of the center section 36, thereby rigidifying and preventing distortion of the central sections.

Reviewing the entire spill sheet structure as a whole, it becomes apparent that the center section 36 forms with the upper portion of the wall 13 a channel-like structure that gives rigidity to the center section. The end plates 45, 46 prevent distortion of the channel-like structure. The outer portions 37, 38, together with the vertical plate portion 31, provide an angle iron beam adjacent or at those end sections to reinforce the end portions of the bucket wall 13. Thus, there is provided a channel-like structure throughout the transverse width of the bucket and along the upper portion of the rear wall 13. This adds greatly to the strength of the bucket. A pair of lift plates 48, 49 are welded to the rear surface of the wall section 40 and to the rear edges of the vertical plates 20, 21. The plates 48, 49 have openings in their centers and notches in their edges for the purpose of receiving and holding chains that may be used to carry or extract products by use of the lift arms of a loader. It should be noted that while the entire structure 30 operates as reinforcing, it nevertheless serves very adequately as a spill sheet having opposite ends thereof recessed so that an operator may review material that might fall or pass over the end sections.

I claim:

1. A spill sheet for a bucket having a rear upwardly and forwardly extending bucket wall terminating in an upper transverse horizontal edge, comprising: a main plate structure extending the full width of the bucket, including a central section having opposite transverse open ends and end sections extending outwardly respectively of said ends of said central section, said central section being composed of a U-shaped forward portion having front and rear spaced apart wall portions joined by a transverse bight portion with said front wall portion having a lower edge fixed to the bucket rear wall at its edge and extending upwardly and forwardly generally in the plane of the rear wall to the bucket, said rear wall portion extending downwardly from the bight portion to join with a vertical portion, the latter having its lower edge fixed to the rear surface of the rear wall spacedly downwardly and rearwardly of the upper edge of the rear wall, said end sections having vertical portions in outward continuations respectively of the vertical portion of the central section, and horizontal portions extending forwardly from the vertical portion to front horizontal edges fixed to the bucket rear wall at its said upper edge; and a pair of filler plates shaped to conform to the open ends of the central section and being fixed to the plate structure for closing said open ends.

2. On a bucket for a power-operated vehicle composed of transversely spaced upright sidewall structures, a transverse cutting edge extending across the front of the bucket at the bottom thereof and a rear wall extending upwardly from the rear portion of the bottom to an upper transverse horizontal edge, the improvement residing in a spill sheet structure comprising: a plate member having a rear lower section extending across the full transverse width of the bucket with the lower edge thereof being welded to the rear surface of said rear wall, said lower section extending upwardly from said lower edge to junctures with a central and two end sections, said central section extending transversely a major portion of the bucket width and having a rear portion extending from its juncture with the lower section upwardly and forwardly to a horizontal rounded upper horizontal edge portion and from thence, to a downwardly and rearwardly extending front portion spaced forwardly from the rear portion and terminating at a lower edge fixed to said rear wall at its upper edge, each of said end sections extending forwardly from their respective junctures with said lower section and terminating at and being fixed to said upper edge of said rear wall, and a pair of plates fixed to the central section at its opposite ends respectively for closing respective gaps formed at said opposite ends by said central section and said end sections.

3. The invention defined in claim 2 characterized by said junctures with the central and end sections being substantially at the level of said transverse horizontal edge when said bucket bottom is substantially horizontal, and said end sections are also substantially horizontal.

4. The invention defined in claim 2, further characterized by a chain-supporting plate being fixed to the rear side of said bucket with at least part thereof being welded to the central section of said plate member.

5. A spill sheet for a bucket having a rear upwardly and forwardly extending bucket wall terminating in an upper transverse horizontal edge, comprising: a main plate structure extending the full width of the bucket, including a central section having opposite transverse open ends and end sections extending outwardly respectively of said ends of said central section, said central section being composed of a U-shaped forward portion having front and rear spaced apart wall portions joined by a transverse bight portion with said front wall portion having a lower edge fixed to the bucket rear wall at its edge and extending upwardly and forwardly therefrom, said rear wall portion extending downwardly from the bight portion to join with a vertical portion, the latter having its lower edge fixed to the rear surface of the rear wall spacedly downwardly and rearwardly of the upper edge of the rear wall, said end sections having vertical portions in outward continuations respectively of the vertical portion of the central section, and portions extending forwardly from the vertical portions at a level lower than said U-shaped portion to front horizontal edges fixed to the bucket rear wall at its said upper edge; and a pair of filler plates shaped to conform to the respective open ends at the ends of the central section and being fixed to the plate structure for closing said open ends.

6. The invention defined in claim 5 in which the ends of said central section and their respective filler plates are inclined upwardly and inwardly between said portions of said end sections and said transverse bight portions.

* * * * *